US011479443B2

(12) United States Patent
Billard

(10) Patent No.: US 11,479,443 B2
(45) Date of Patent: Oct. 25, 2022

(54) ELEVATOR BRAKE ASSEMBLY WITH ELECTROMAGNET ASSEMBLY AND PERMANENT MAGNET ASSEMBLY THAT ENGAGE ONE ANOTHER

(71) Applicant: OTIS ELEVATOR COMPANY, Farmington, CT (US)

(72) Inventor: Justin Billard, Amston, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 274 days.

(21) Appl. No.: 16/793,279

(22) Filed: Feb. 18, 2020

(65) Prior Publication Data

US 2021/0253396 A1 Aug. 19, 2021

(51) Int. Cl.

| | |
|---|---|
| ***B66B 5/18*** | (2006.01) |
| ***B66B 1/36*** | (2006.01) |
| ***B66B 9/00*** | (2006.01) |

(52) U.S. Cl.

CPC ..... *B66B 5/18* (2013.01); *B66B 1/36* (2013.01); *B66B 9/00* (2013.01)

(58) Field of Classification Search

CPC ..... B66B 1/36; B66B 5/18

See application file for complete search history.

(56) References Cited

U.S. PATENT DOCUMENTS

| | | | | |
|---|---|---|---|---|
| 5,467,850 | A * | 11/1995 | Skalski | B66B 5/16 187/373 |
| 5,791,442 | A * | 8/1998 | Arnold | H01F 5/00 188/164 |
| 2017/0001835 | A1 | 1/2017 | Hu et al. | |

FOREIGN PATENT DOCUMENTS

| | | | | |
|---|---|---|---|---|
| CN | 205397800 | U | 7/2016 | |
| CN | 205739864 | U * | 11/2016 | |
| CN | 106395544 | A | 2/2017 | |
| EP | 3112306 | A1 | 1/2017 | |
| JP | H09202558 | A | 8/1997 | |
| WO | WO-2014077813 | A1 * | 5/2014 | B66B 5/18 |
| WO | 2017087978 | A1 | 5/2017 | |
| WO | WO-2017098299 | A1 * | 6/2017 | B66B 5/044 |

OTHER PUBLICATIONS

European Search Report Issued in European Application No. 20214591.8-1017 dated Jun. 1, 2021; 8 Pages.

Chinese Office Action; dated May 30, 2022; Application No. 202011394281.5; Filed: Dec. 3, 2020; 7 pages.

* cited by examiner

*Primary Examiner* — Diem M Tran

(74) *Attorney, Agent, or Firm* — Cantor Colburn LLP

(57) ABSTRACT

Disclosed is a brake assembly for an elevator system, having: a housing defining a housing cavity, a housing forward end with a forward end opening into the housing cavity, and a housing aft end; a first magnet disposed in the housing cavity, near the forward end opening; a second magnet disposed in the housing cavity, between the first magnet and the housing aft end, and wherein the second magnet is configured to: reduce attraction between itself and the first magnet, whereby the first magnet moves at least partially through the forward end opening to engage a guide rail that is metallic, thereby preventing vertical movement of the first magnet of the brake assembly, when magnetically connected to the rail, relative to the housing; and attract the first magnet to draw the first magnet into the housing cavity.

14 Claims, 8 Drawing Sheets

200

200

ELEVATOR BRAKE ASSEMBLY WITH ELECTROMAGNET ASSEMBLY AND PERMANENT MAGNET ASSEMBLY THAT ENGAGE ONE ANOTHER

BACKGROUND

The embodiments herein relate to an elevator brake assembly and more specifically to an elevator brake assembly with an electromagnet assembly and a permanent magnet assembly that engage one another.

In elevators, the stretch of the belts or ropes can be significant. This can lead to bounce in the car as passengers enter or leave the car. The resulting car sag can also cause the car to no longer be level with the landing. Sag and bounce are undesirable to passengers and may also create a trip hazard for passengers entering or leaving the car.

BRIEF SUMMARY

Disclosed is a brake assembly for an elevator system, including: a housing defining a housing cavity, a housing forward end with a forward end opening into the housing cavity, and a housing aft end; a first magnet disposed in the housing cavity, near the forward end opening; a second magnet disposed in the housing cavity, between the first magnet and the housing aft end, and wherein the second magnet is configured to: reduce attraction between itself and the first magnet, whereby the first magnet moves at least partially through the forward end opening to engage a guide rail that is metallic, thereby preventing vertical movement of the first magnet of the brake assembly, when magnetically connected to the rail, relative to the housing; and attract the first magnet to draw the first magnet into the housing cavity.

In addition to one or more of the above disclosed aspects or as an alternate, the first magnet assembly includes a permanent magnet assembly and the second magnet is an electromagnet assembly.

In addition to one or more of the above disclosed aspects or as an alternate, a brake pad is formed by a forward end of the first magnet assembly.

In addition to one or more of the above disclosed aspects or as an alternate, the housing defines a housing plate and the housing plate defines one or more mounting orifices for connecting with an elevator car.

In addition to one or more of the above disclosed aspects or as an alternate, the housing defines a housing block, and the housing block defines the housing cavity.

In addition to one or more of the above disclosed aspects or as an alternate, the assembly further includes a biasing member connected to the second magnet for biasing the second magnet in an aft direction; wherein the second magnet is configured to attract the first magnet, whereby the second magnet moves to engage the first magnet, whereby the biasing member moves the first magnet and the second magnet into the housing cavity; and wherein the biasing member includes a shaft that extends through an opening in the housing aft end to engage the permanent magnet assembly, wherein the shaft is biased in the aft direction.

In addition to one or more of the above disclosed aspects or as an alternate, a guide bolt defines the shaft, wherein the guide bolt includes a bolt head that is spaced apart from the housing aft end, and a coil spring extends between the housing aft end and the bolt head, thereby biasing the second magnet in the aft direction.

In addition to one or more of the above disclosed aspects or as an alternate, the assembly further includes a plurality of the biasing members spaced apart from one another along the housing aft end.

Further disclosed is an elevator system including: an elevator car; a guide rail that is adjacent the elevator car, wherein the guide rail is metallic; and a brake assembly connected to the elevator car, the brake assembly including: a housing defining a housing cavity, a housing forward end with a forward end opening into the housing cavity, and a housing aft end, wherein the forward end opening is near the guide rail; a first magnet disposed in the housing cavity, near the forward end opening; a second magnet disposed in the housing cavity, between the first magnet and the housing aft end; and wherein the second magnet is configured to: reduce attraction between itself and the first magnet, whereby the first magnet moves at least partially through the forward end opening to engage the guide rail, thereby preventing vertical movement of the elevator car relative to the guide rail; and attract the first magnet to draw the first magnet into the housing cavity.

In addition to one or more of the above disclosed aspects or as an alternate, the first magnet is a permanent magnet assembly and the second magnet is an electromagnet assembly.

In addition to one or more of the above disclosed aspects or as an alternate, a brake pad is formed by a forward end of the first magnet.

In addition to one or more of the above disclosed aspects or as an alternate, the housing defines a housing plate and the housing plate defines one or more mounting orifices for connecting with the elevator car.

In addition to one or more of the above disclosed aspects or as an alternate, the housing defines a housing block, and the housing block defines the housing cavity.

In addition to one or more of the above disclosed aspects or as an alternate, the system further includes a biasing member connected to the second magnet for biasing the second magnet in an aft direction; wherein the second magnet is configured to attract the first magnet, whereby the second magnet moves to engage the first magnet, whereby the biasing member moves the first magnet and the second magnet into the housing cavity; and wherein the biasing member includes a shaft that extends through an opening in the housing aft end to engage the permanent magnet assembly, wherein the shaft is biased in the aft direction.

In addition to one or more of the above disclosed aspects or as an alternate, a guide bolt defines the shaft, wherein the guide bolt includes a bolt head that is spaced apart from the housing aft end, and a coil spring extends between the housing aft end and the bolt head, thereby biasing the second magnet in the aft direction.

In addition to one or more of the above disclosed aspects or as an alternate, the system further includes a plurality of the biasing members spaced apart from one another along the housing aft end.

In addition to one or more of the above disclosed aspects or as an alternate, the system further includes a controller for controlling power to the electromagnet assembly, the controller being configured to: energize the electromagnet assembly to a first polarity to reduce attraction between the first magnet and the second magnet; and energize the electromagnet assembly to a second polarity that opposes the first polarity to attract the permanent magnet assembly and the electromagnet assembly to one another.

Further disclosed is a method of operating a brake assembly of an elevator system, wherein the brake assembly is connected to an elevator car that moves along an elevator guide rail, the elevator guide rail being metallic, the method including: energizing to a first polarity an electromagnet assembly in a housing cavity defined by a housing block of a housing of the brake assembly, thereby reducing attraction between first and second magnets, wherein the first magnet is a permanent magnet assembly and the second magnet is the electromagnet assembly, moving the first magnet at least partially through a forward end opening of the housing toward the elevator guide rail by energizing the electromagnet assembly to the first polarity; engaging a brake pad of the permanent magnet assembly against the elevator guide rail by moving the permanent magnet assembly at least partially through the forward end opening of the housing; and preventing vertical movement of the elevator car relative to the guide rail by engaging the brake pad of the permanent magnet assembly against the elevator guide rail.

In addition to one or more of the above disclosed aspects or as an alternate, the method further includes energizing to a second polarity the electromagnet assembly; attracting to one another the permanent magnet assembly that is engaged against the guide rail and the electromagnet assembly that is energized to the second polarity; moving, from the attracting, the electromagnet assembly toward the permanent magnet assembly so that the electromagnet assembly and the permanent magnet assembly engage one another; and decreasing attraction between the permanent magnet assembly and the guide rail by engagement between the permanent magnet assembly and the electromagnet assembly that is energized to the second polarity.

In addition to one or more of the above disclosed aspects or as an alternate, the method further includes biasing in an aft direction, into the housing cavity, the permanent magnet assembly and the electromagnet assembly that are engaged with one another, while the electromagnet assembly is energized to the second polarity, thereby disengaging the guide rail and the permanent magnet assembly from one another.

BRIEF DESCRIPTION OF THE DRAWINGS

The present disclosure is illustrated by way of example and not limited in the accompanying figures in which like reference numerals indicate similar elements.

DETAILED DESCRIPTION

A detailed description of one or more embodiments of the disclosed apparatus and method are presented herein by way of exemplification and not limitation with reference to the Figures.

Figure 1:
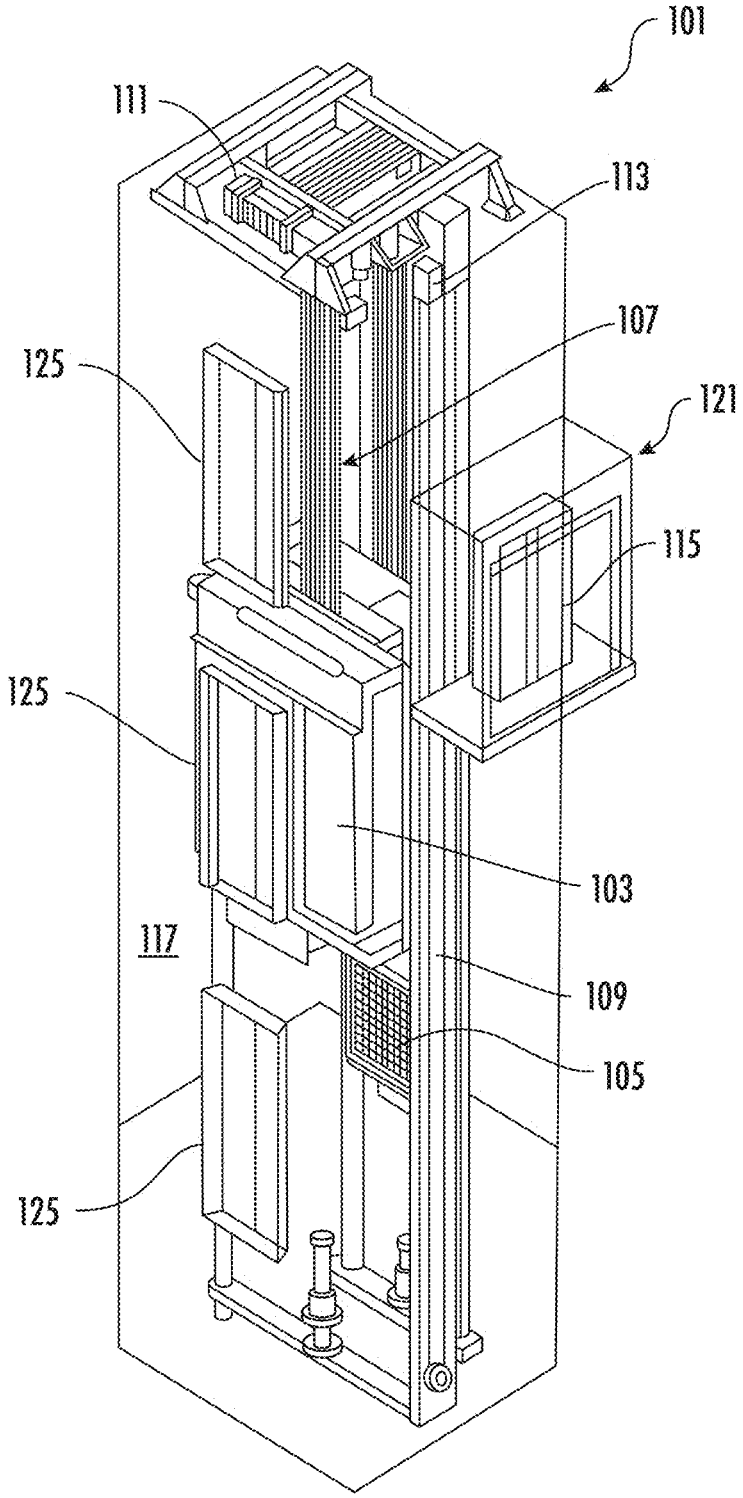
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 and drive are located, as shown, in a controller room 121 of the elevator shaft 117 and is configured to control the operation of the elevator system 101, and particularly the elevator car 103. For example, the controller 115 and drive may provide drive signals to the machine 111 to control the acceleration, deceleration, leveling, stopping, etc. of the elevator car 103. The controller 115 and drive may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
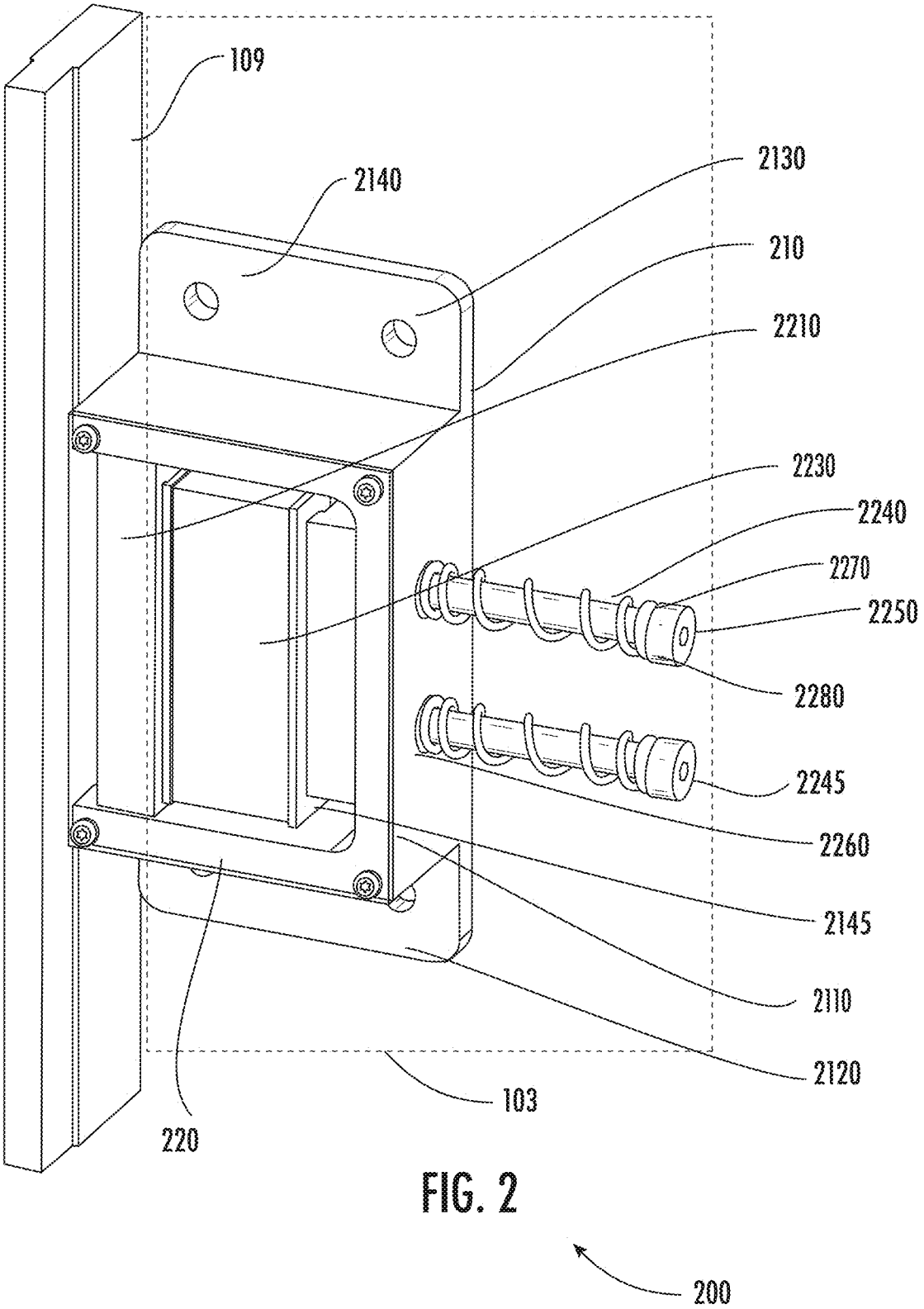
FIG. 2 is a side perspective view of a brake assembly according to an embodiment.
Figure 3:
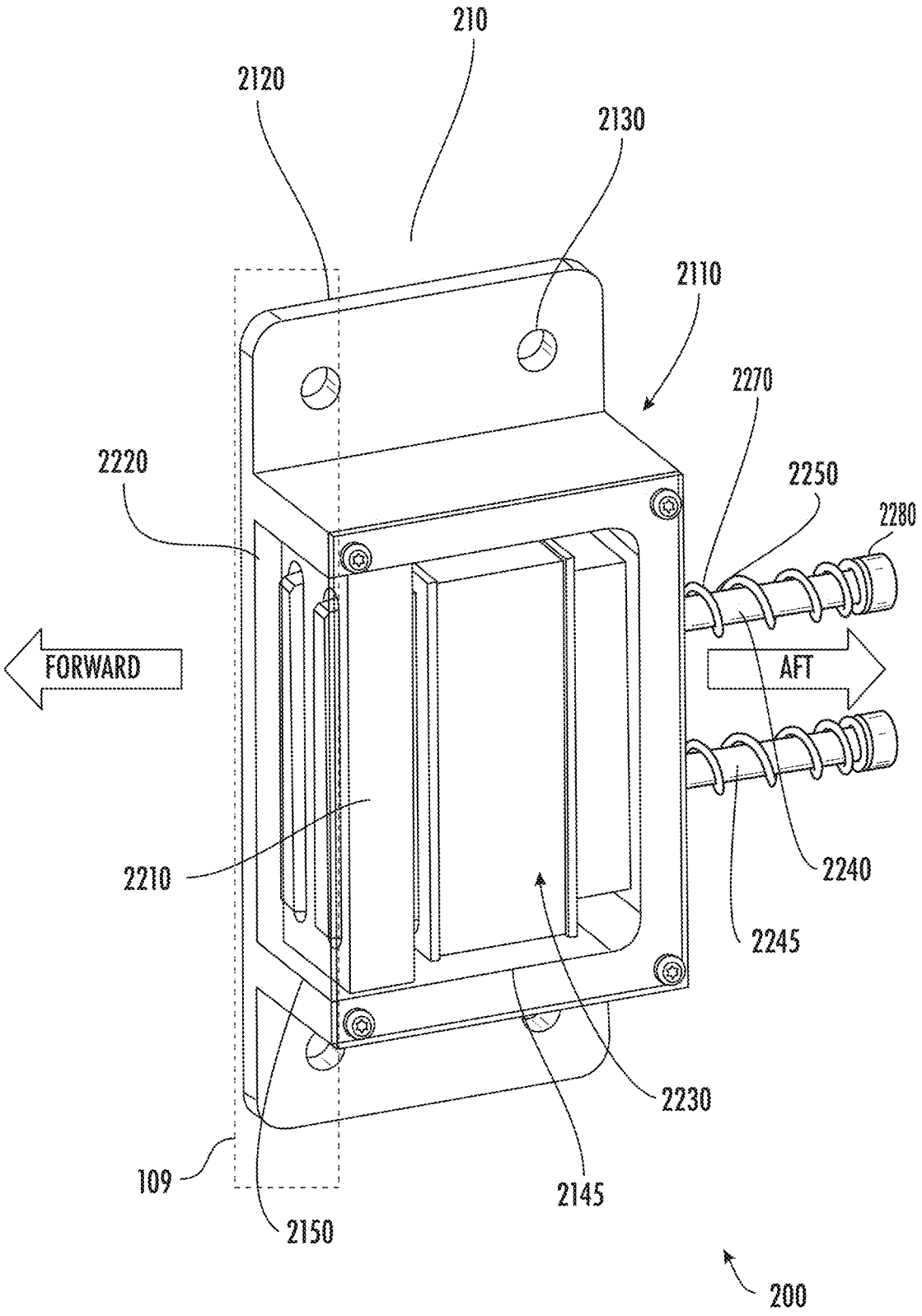
FIG. 3 is another side perspective view of a brake assembly according to an embodiment.

Turning to FIGS. 2 and 3, a brake assembly 200 for the elevator car 103 is shown. The brake assembly 200 is configured to substantially prevent vertical movement of the elevator car 103 relative to the guide rail 109 by reducing or removing sag of the tension member 107 (e.g., the belt) and bounce of the elevator car 103. The brake assembly 200 may be utilized as a supplemental brake, e.g., in addition to braking applied by the machine 111 to the tension member 107.

The brake assembly 200 includes a housing 210 configured to be connected to the elevator car 103 (see FIG. 2) to apply a braking force against the guide rail 109. With this configuration, braking forces generated by the brake assembly 200 may be distributed through the structure of the elevator car 103. For example, the housing 210 may have a housing block 2110 (e.g., a generally rectangular structure) connected to a housing plate 2120 that is configured for being mounted to a side of the elevator car 103. The housing plate 2120 may define one or more mounting orifices 2130, e.g., for receiving mounting bolts 2140 (see FIG. 2) when mounting to the elevator car 103.

In an alternative embodiment the elevator mounting bolts pass directly through holes in the housing block 2110. In such an embodiment, no plate like feature (e.g., housing plate 2120) of the housing 2110 is necessary. Alternatively, other means of fastening the housing 2110 to the elevator are within the scope of the disclosure. For example, the housing block 210 could include flexible plastic features (i.e. snaps) that clip into holes in the side of the elevator.

A housing cavity 2145 is defined by the housing block 2110. In addition a housing forward end of the housing block 2110 may define a housing forward end opening 2150 (see FIG. 3) that opens into the housing cavity 2145. The housing forward end opening 2150 may face the guide rail 109.

A magnet set 220 is disposed within the housing cavity 2145. The magnet set 220 includes a permanent magnet assembly 2210 (a first magnet) near the housing forward end opening 2150. The permanent magnet assembly 2210 is configured to move in a forward direction, e.g., to at least partially exit the housing cavity 2145 and engage the guide rail 109 (see FIG. 5). The permanent magnet assembly 2210 is configured to move in an aft direction, e.g., when being retracted from the guide rail 109 into the housing cavity 2145 (see FIG. 4).

A brake pad 2220, which is magnetic, is formed by a forward end of the permanent magnet assembly 2210. The brake pad 2220 is configured to move in the forward and aft directions with the permanent magnet assembly 2210. The brake pad 2220 is configured to apply a friction force when disposed against the guide rail 109.

A first biasing member 2240 is connected to an aft end of the permanent magnet assembly 2210. The first biasing member 2240 is configured to bias the permanent magnet assembly 2210 in the aft direction. The first biasing member 2240 includes a guide bolt 2250 extending through a bolt opening 2260 (FIG. 2) in the aft end of the housing block 2110. A coil spring 2270 extends between the aft end of the housing block 2110 and a bolt head 2280. That is, a diameter of the coil spring 2270 is greater than the first bolt opening 2260 and less than the bolt head 2280.

The coil spring 2270 is configured so that it is in compression, at least while an electromagnet assembly 2230 (a second magnet) is moved in the forward direction, discussed below. In one embodiment a plurality of biasing members including the first biasing member 2240 and a second biasing member 2245 are spaced apart from one another along the aft end of the housing block 2110. Discussion herein directed to the first biasing member 2240 and its interaction with the brake assembly 200 shall apply equally to each of the plurality of biasing members.

As indicated the magnet set 220 includes the electromagnet assembly 2230, which is located adjacent in the aft direction to the permanent magnet assembly 2210 within the housing cavity 2145. The electromagnet assembly 2230 is configured for being utilized, as indicated below, by the controller 115, to position the permanent magnet assembly 2210 against the guide rail 109 and retract the permanent magnet assembly 2210 into the housing cavity 2145.

Figure 4:
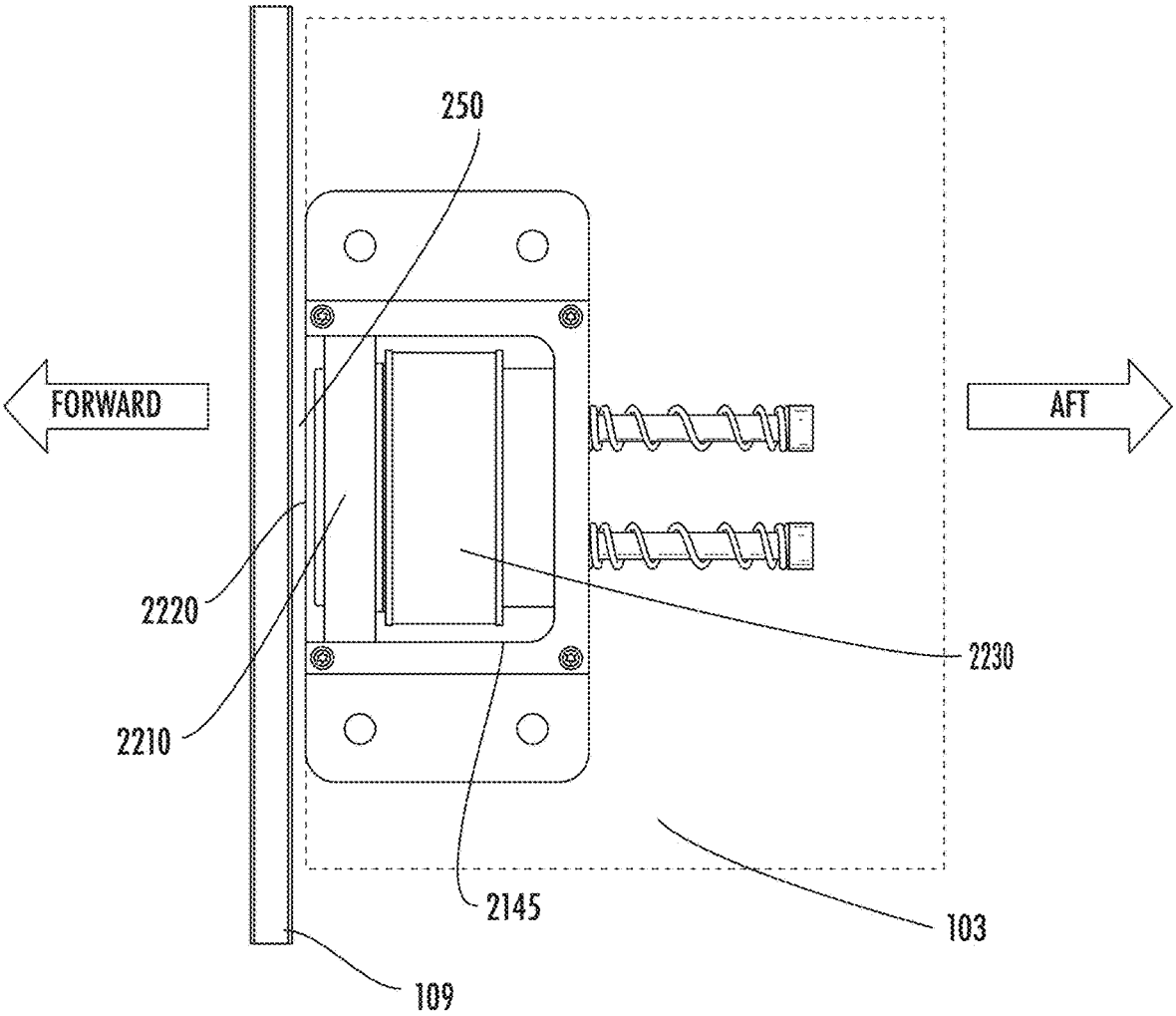
FIG. 4 is a side view of a brake assembly according to an embodiment with a permanent magnet assembly retracted into a housing cavity of a housing block.

Turning to FIG. 4, the brake assembly 100, connected to the elevator car 103, is shown in an initial condition. The permanent magnet assembly 2210 is retracted within the housing cavity 2145. The electromagnet assembly 2230 is not powered. The brake pad 2220 is spaced in the aft direction from the guide rail 109. For example, a gap 250 is between the guide rail 109 and the brake pad 2220.

Figure 5:
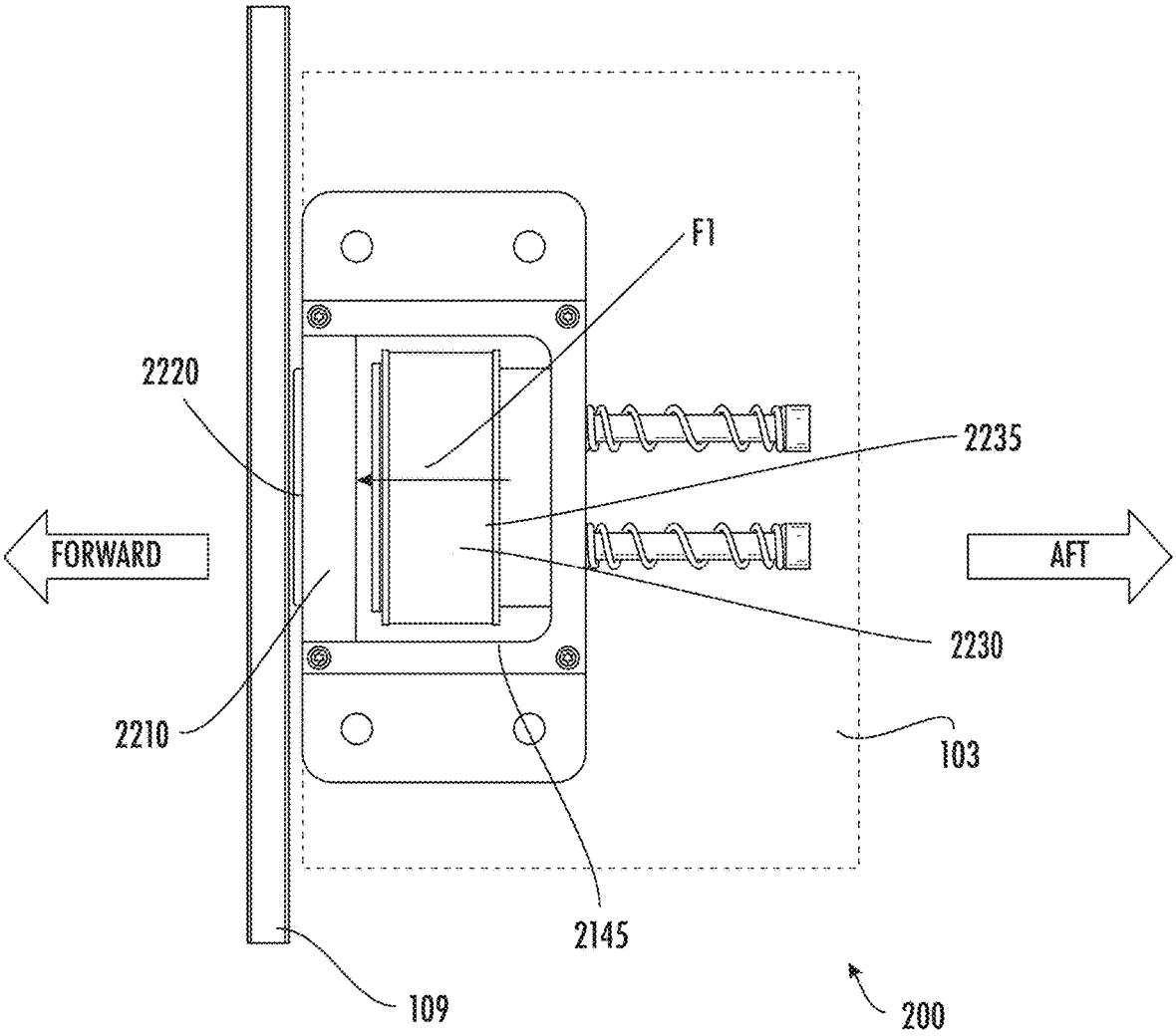
FIG. 5 is a side view of a brake assembly according to an embodiment with a permanent magnet assembly extending from a housing cavity of a housing block and an electromagnet assembly energized to a first polarity.

Turning to FIG. 5, the brake assembly 100, connected to the elevator car 103, is shown in a braking condition, which substantially prevents vertical movement of the elevator car 103 relative to the guide rail 109. The electromagnet assembly 2230 includes coil windings 2235 which are energized to a first polarity to thereby repel the permanent magnet assembly 2210. This results in a net force F1 on the magnet assembly that moves it toward the rail.

The permanent magnet assembly 2210 is moved in the forward direction in the housing cavity 2145 by the repelling forces, toward the guide rail 109. The normal magnet forces in the permanent magnet assembly 2210 cause the permanent magnet assembly 2210 to stick to the guide rail 109. The brake pad 2220 provides friction forces to the guide rail 109, thereby limiting vertical motion of the permanent magnet assembly 2210 relative to the brake housing 210, and thus limiting vertical movement of the elevator car 103 relative to the rail 109. At this time, power to the electromagnet assembly 2230 may be stopped.

Figure 6:
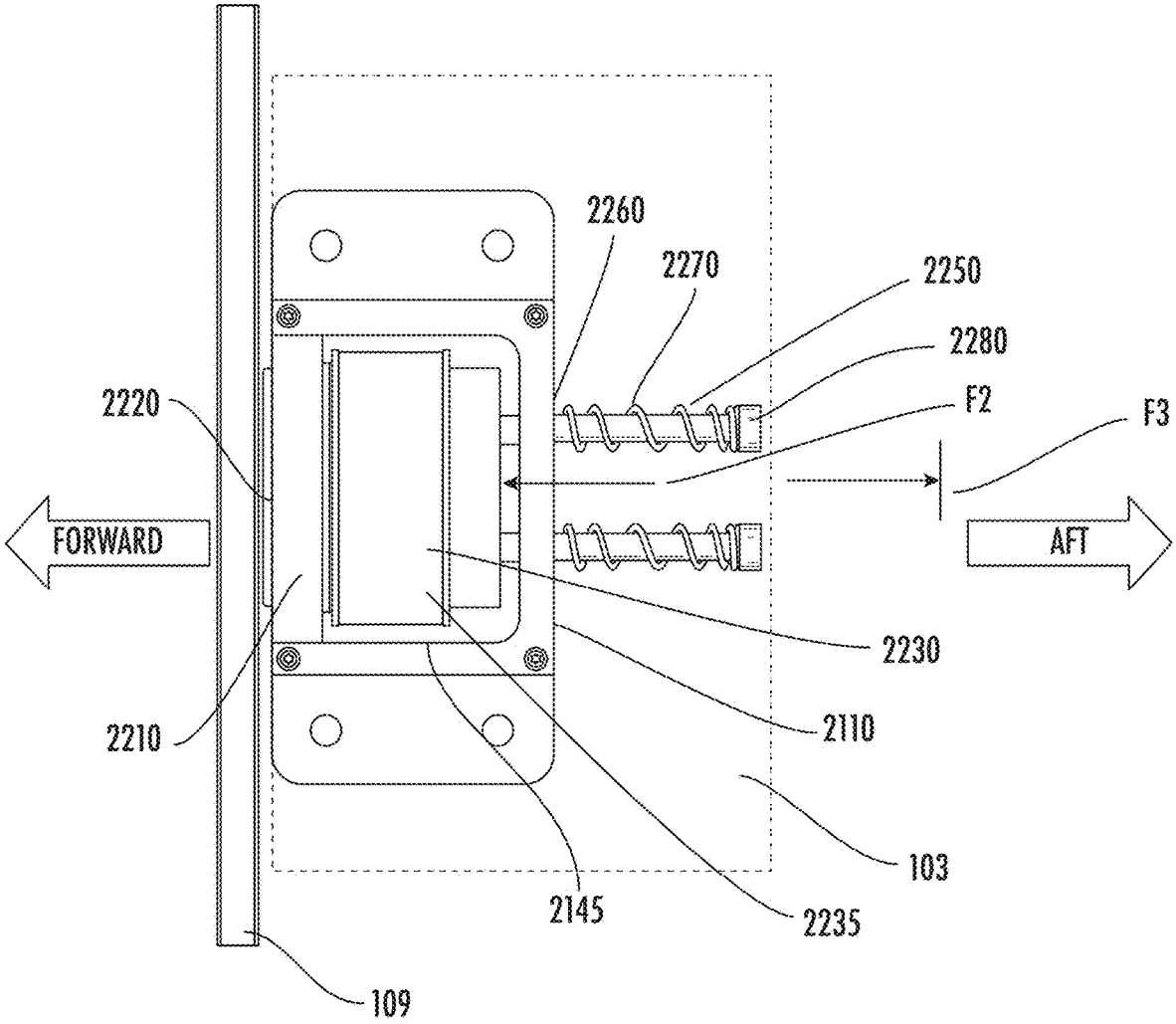
FIG. 6 is a side view of a brake assembly according to an embodiment with a permanent magnet assembly extending from a housing cavity of a housing block and an electromagnet assembly energized to a second polarity.

Turning to FIG. 6, the brake assembly 100, connected to the elevator car 103, is shown in a resetting condition. To disengage brake pad 2220 from the guide rail 109, the coil windings 2235 are energized to a second polarity that is the reverse of the first polarity. The electromagnet assembly 2230 is moved in the forward direction by an attractive force F2 so that the electromagnet assembly 2230 is within close proximity to, and ultimately sticks to, the permanent magnet assembly 2210. The magnetic interaction between the electromagnet assembly 2230 and the permanent magnet assembly 2210 decreases the attractive forces between the permanent magnet assembly 2210 and the guide rail 109.

With the electromagnet assembly 2230 moved in the forward direction, the guide bolt 2250 is also moved in the forward direction. This compresses the coil spring 2270 between the aft end of the housing block 2110 at the bolt opening 2260 and the bolt head 2280 of the guide bolt 2250. The spring force F3 generated by the compressed coil spring 270 overcomes the remaining magnet force between the permanent magnet assembly 2210 and the guide rail 109. The electromagnet assembly 2230 and the permanent magnet assembly 2210, with the brake pad 2220, move together in the aft direction to the position illustrated in FIG. 4. At this time power to the electromagnet assembly 2230 may be stopped. The elevator car 103 may be moved relative to the guide rail 109. The utilization of the bolt 2250 and the spring 270 are just one example of many possible means for generating a biasing force such as the spring force F3. Other such means are within the scope of the disclosure.

In alternate embodiments the electromagnetic assembly does not move toward the permanent magnet assembly. Rather, the influence from the electromagnetic assembly is sufficient to draw the permanent magnet assembly back to it. In such embodiments the biasing members (guide bolts 2250 and springs 270) are not needed.

Figure 7:
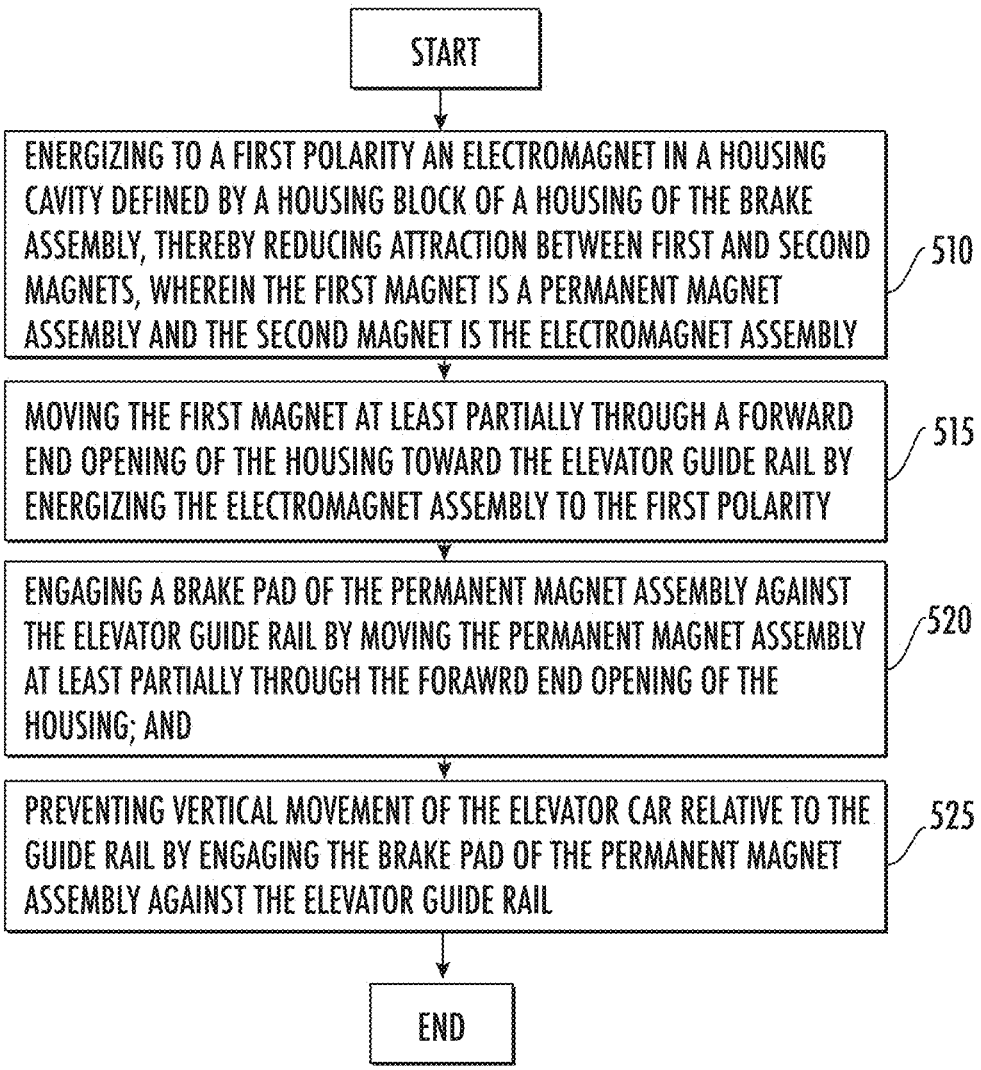
FIG. 7 is flowchart showing a method of operating a brake assembly according to an embodiment.
Figure 8:
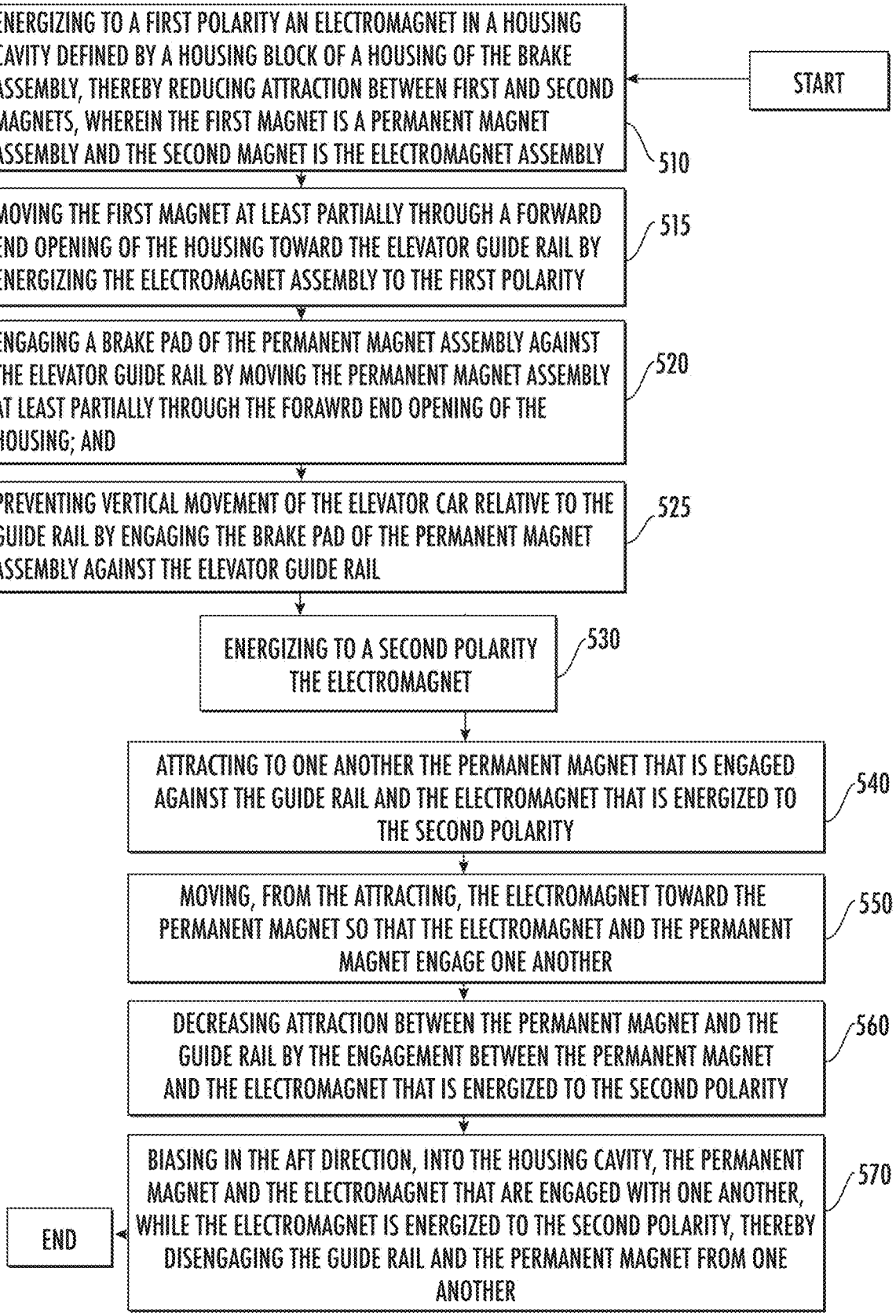
FIG. 8 is flowchart showing additional aspects of the method of operating the brake assembly according to an embodiment.

Turning to FIGS. 7 and 8, each shows a flowchart of a method of operating the brake assembly 200 of the elevator system 101. The brake assembly 200 is connected to the elevator car 103. As shown in block 510 the method includes energizing to a first polarity an electromagnet assembly 2230 in the housing cavity 2145 defined by a housing block 2110 of a housing 210 of the brake assembly 200. From this, attraction is reduced between the first and second magnets. As indicated the first magnet 2210 is the permanent magnet assembly and the second magnet 2230 is the electromagnet assembly.

As shown in block 515, the method includes moving the first magnet 2210 at least partially through the forward end opening 2150 of the housing 210 toward the elevator guide rail 109 by energizing the electromagnet assembly 2230 to the first polarity. As shown in block 520, the method includes engaging the brake pad 2220 of the permanent magnet assembly 2210 against the elevator guide rail 109 by moving the permanent magnet assembly 2210 at least partially through the forward end opening of the housing 210.

As shown in block 525, the method includes preventing vertical movement of the elevator car 103 relative to the guide rail 109 by engaging the brake pad 2220 of the permanent magnet assembly 2210 against the guide rail 109.

Turning to FIG. 8, as shown in block 530, the method may further include energizing to the second polarity the electromagnet assembly 2230. As shown in block 540 the method may include attracting to one another the permanent magnet assembly 2210 that is engaged against the guide rail 109 and the electromagnet assembly 2230 that is energized to the second polarity. As shown in block 550 the method may include moving, from the attracting, the electromagnet assembly 2230 toward the permanent magnet assembly 2210 so that the electromagnet assembly 2230 and the permanent magnet assembly 2210 engage one another. As shown in block 560 the method may further include decreasing attraction between the permanent magnet assembly 2210 and the guide rail 109 by the engagement between the permanent magnet assembly 2210 and the electromagnet assembly 2230 that is energized to the second polarity.

As shown in block 570 the method may further include biasing in the aft direction, into the housing cavity 2145, the permanent magnet assembly 2210 and the electromagnet assembly 2230 that are engaged with one another, while the electromagnet assembly 2230 is energized to the second polarity. From this, the guide rail 109 and the permanent magnet assembly 2210 are disengaged from one another.

The above disclosed solution to elevator sag and bounce provides a car-mounted device that applies a clamping force to the rail. The disclosed embodiments provide a cost-effective solution. A braking force provided by the disclosed brake pad is transmitted to the car frame, through the housing, to prevent slippage.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A brake assembly for an elevator system, comprising:

a housing defining a housing block, and the hosing block defining a housing cavity, a housing forward end with a forward end opening into the housing cavity, and a housing aft end;

a first magnet disposed in the housing cavity, near the forward end opening;

a second magnet disposed in the housing cavity, between the first magnet and the housing aft end, wherein the first magnet includes a permanent magnet assembly and the second magnet is an electromagnet assembly, and a brake pad, which is magnetic, is formed by a forward end of the first magnet, and wherein the second magnet is configured to:

reduce attraction between itself and the first magnet, whereby the first magnet moves partially through the forward end opening to engage a guide rail that is metallic, thereby preventing vertical movement of the first magnet of the brake assembly, when magnetically connected to the rail, relative to the housing, by transmitting braking force from the brake pad through the housing block; and attract the first magnet to draw the first magnet into the housing cavity.

2. The brake assembly of claim 1, wherein the housing defines a housing plate and the housing plate defines one or more mounting orifices for connecting with an elevator car.

3. The brake assembly of claim 1, comprising:

a biasing member connected to the second magnet for biasing the second magnet in an aft direction;

wherein the second magnet is configured to attract the first magnet, whereby the second magnet moves to engage the first magnet, whereby the biasing member moves the first magnet and the second magnet into the housing cavity; and wherein the biasing member includes a shaft that extends through an opening in the housing aft end to engage the permanent magnet assembly, wherein the shaft is biased in the aft direction.

4. The brake assembly of claim 3, wherein a guide bolt defines the shaft, wherein the guide bolt includes a bolt head that is spaced apart from the housing aft end, and a coil spring extends between the housing aft end and the bolt head, thereby biasing the second magnet in the aft direction.

5. The brake assembly of claim 4, comprising a plurality of the biasing members spaced apart from one another along the housing aft end.

6. An elevator system including:

an elevator car;

a guide rail that is adjacent the elevator car, wherein the guide rail is metallic; and a brake assembly connected to the elevator car, the brake assembly comprising:

a housing defining a housing block, and the hosing block defining a housing cavity, a housing forward end with a forward end opening into the housing cavity, and a housing aft end;

a first magnet disposed in the housing cavity, near the forward end opening;

a second magnet disposed in the housing cavity, between the first magnet and the housing aft end, wherein the first magnet includes a permanent magnet assembly and the second magnet is an electromagnet assembly, and a brake pad, which is magnetic, is formed by a forward end of the first magnet, and wherein the second magnet is configured to:

reduce attraction between itself and the first magnet, whereby the first magnet moves partially through the forward end opening to engage a guide rail that is metallic, thereby preventing vertical movement of the first magnet of the brake assembly, when magnetically connected to the rail, relative to the housing, by transmitting braking force from the brake pad through the housing block; and attract the first magnet to draw the first magnet into the housing cavity.

7. The elevator system of claim 6, wherein the housing defines a housing plate and the housing plate defines one or more mounting orifices for connecting with the elevator car.

8. The elevator system of claim 6, comprising:

a biasing member connected to the second magnet for biasing the second magnet in an aft direction;

wherein the second magnet is configured to attract the first magnet, whereby the second magnet moves to engage the first magnet, whereby the biasing member moves the first magnet and the second magnet into the housing cavity; and wherein the biasing member includes a shaft that extends through an opening in the housing aft end to engage the permanent magnet assembly, wherein the shaft is biased in the aft direction.

9. The elevator system of claim 8, wherein a guide bolt defines the shaft, wherein the guide bolt includes a bolt head that is spaced apart from the housing aft end, and a coil spring extends between the housing aft end and the bolt head, thereby biasing the second magnet in the aft direction.

10. The elevator system of claim 9, comprising a plurality of the biasing members spaced apart from one another along the housing aft end.

11. The elevator system of claim 6, including a controller for controlling power to the electromagnet assembly, the controller being configured to:

energize the electromagnet assembly to a first polarity to reduce attraction between the first magnet and the second magnet; and energize the electromagnet assembly to a second polarity that opposes the first polarity to attract the permanent magnet assembly and the electromagnet assembly to one another.

12. A method of operating a brake assembly of an elevator system, wherein the brake assembly includes:

a housing defining a housing block, and the hosing block defining a housing cavity, a housing forward end with a forward end opening into the housing cavity, and a housing aft end;

a first magnet disposed in the housing cavity, near the forward end opening;

a second magnet disposed in the housing cavity, between the first magnet and the housing aft end, wherein the first magnet includes a permanent magnet assembly and the second magnet is an electromagnet assembly, and a brake pad, which is magnetic, is formed by a forward end of the first magnet, and wherein the second magnet is configured to:

reduce attraction between itself and the first magnet, whereby the first magnet moves partially through the forward end opening to engage a guide rail that is metallic, thereby preventing vertical movement of the first magnet of the brake assembly, when magnetically connected to the rail, relative to the housing; and attract the first magnet to draw the first magnet into the housing cavity, and the brake assembly is connected to an elevator car that moves along an elevator guide rail, the elevator guide rail being metallic, the method comprising:

energizing to a first polarity the electromagnet assembly, thereby reducing attraction between the first and second magnets, moving the first magnet through the forward end opening of the housing toward the elevator guide rail by energizing the electromagnet assembly to the first polarity;

engaging the brake pad of the permanent magnet assembly against the elevator guide rail by moving the permanent magnet assembly partially through the forward end opening of the housing; and preventing vertical movement of the elevator car relative to the guide rail by engaging the brake pad of the permanent magnet assembly against the elevator guide rail and transmitting braking force from brake pad through the housing block.

13. The method of claim 12, further comprising:

energizing to a second polarity the electromagnet assembly;

attracting to one another the permanent magnet assembly that is engaged against the guide rail and the electromagnet assembly that is energized to the second polarity;

moving, from the attracting, the electromagnet assembly toward the permanent magnet assembly so that the electromagnet assembly and the permanent magnet assembly engage one another; and decreasing attraction between the permanent magnet assembly and the guide rail by engagement between the permanent magnet assembly and the electromagnet assembly that is energized to the second polarity.

14. The method of claim 13, further comprising:

biasing in an aft direction, into the housing cavity, the permanent magnet assembly and the electromagnet assembly that are engaged with one another, while the electromagnet assembly is energized to the second polarity, thereby disengaging the guide rail and the permanent magnet assembly from one another.

* * * * *